United States Patent [19]

Rabinovich et al.

[11] 4,008,752

[45] Feb. 22, 1977

[54] PLANT FOR THE ELECTROSLAG MELTING OF SHAPED CASTINGS

[76] Inventors: Volf Iudovich Rabinovich, ulitsa Gagarina, 74, kv. 27; Jury Nikolaevich Kriger, ulitsa Oktyabrskaya, 38, kv. 59; Oleg Stepanovich Karpov, ulitsa Gagarina, 19, kv. 4; Viktor Evgenievich Sapunov, ulitsa Gagarina, 60, kv. 10; Vladimir Alexeevich Karpov, ulitsa Gagarina, 43, kv. 39; Vladimir Yakovlevich Kovenya, ulitsa Gagarina, 84, kv. 12, all of Chekhov Moskovskoi oblasti, U.S.S.R.

[22] Filed: Apr. 18, 1975

[21] Appl. No.: 569,375

[52] U.S. Cl. ..... 164/252

[51] Int. Cl.[2] ..... B22D 27/02

[58] Field of Search ..... 164/52, 251, 252, 341; 249/161, 165, 166, 168; 425/330

[56] References Cited

UNITED STATES PATENTS

| | | | |
|---|---|---|---|
| 3,129,473 | 4/1964 | Veil | 164/252 |
| 3,610,318 | 10/1971 | Simmons | 164/252 |
| 3,921,698 | 11/1975 | Grof | 164/52 |

FOREIGN PATENTS OR APPLICATIONS

| | | | |
|---|---|---|---|
| 1,230,197 | 4/1971 | United Kingdom | 164/52 |

*Primary Examiner*—Robert Louis Spruill
*Attorney, Agent, or Firm*—Holman & Stern

[57] ABSTRACT

A plant for electroslag casting of shaped products having a base plate consisting of at least three sections interconnected with each other by a resilient member, with an element to be fused being inserted into the melting zone of a mold through an orifice in the base plate, said element being provided with means enabling it to move vertically; current being supplied to said element being fused through current-carrying jaws movable in a horizontal plane and connected with means forcing them against the element being fused. The plant is intended for producing high-quality billets for manufacturing key components; it helps reduce production costs and eliminate welding from the production process.

3 Claims, 4 Drawing Figures

PLANT FOR THE ELECTROSLAG MELTING OF SHAPED CASTINGS

BACKGROUND OF THE INVENTION

The present invention relates to electrometallurgy and, more particularly, to a plant for effecting the method of electroslag melting of shaped castings.

The present invention may prove to be most advantageous in mechanical engineering for producing parts and units which should meet more stringent requirements as to their quality, such as, blanks for covers and bodies of fittings for atomic power plants, rolls for cold rolling mills, crankshafts, T-pieces and connecting rods intended to replace forged or forged-and-welded constructions of similar designation. The first lots of rolls for cold rolling mills produced on an industrial scale from metal obtained by the electroslag melting technique and tested under service conditions have proved that the service life of such rolls has been extended almost 2 or 3 times.

High quality and homogeneity of metal of ingots obtained by the electroslag process have suggested an idea about the possibility of using cast mill rolls produced by the electroslag remelting technique in shaped molds.

Known in the art are methods of producing blanks for, e.g., mill rolls, by the electroslag remelting techniques, in which a single or a plurality of metal electrodes are melted one after another in slag baths. In this case melting is accomplished at least in two cooled molds of different cross sections mounted one above another on individual jack carriages. The jack carriages carrying the molds and that mount the electrodes and arranged above the first carriages are capable of moving vertically along the masts.

The disadvantages peculiar to these methods and to the above-described plant reside in that when producing blanks differing in their cross-sectional heights, for melting blanks of each cross section it is necessary to use different electrodes and the replacement of these electrodes during the melting process causes shutdowns which adversely affect the quality of metal of the blanks being melted. Moreover, in the course of melting the amount of slag should be varied, increased or decreased, which causes inconvenience in servicing the casters.

More suitable are the methods of melting mill roll blanks by the electroslag remelting technique in a mold whose diameter corresponds to that of a roll barrel. An element to be remelted, corresponding in shape and size to a roll neck is set up in a mold on a base plate side and is fused to a base of a blank at the beginning of the process. The mold base plate has an opening whose diameter corresponds to that of the element being fused and forming the roll neck. The base plate is split vertically into two parts under which are mounted current-carrying prisms.

However, the above method and plant do not provide as well the guaranteed quality in the fusion zone wherein the element being fused is fused to the blank. Moreover, since the base plate is split vertically into two parts, it is warped owing to thermal expansion of the element being fused upon heating, and after the first heat the opening does not correspond anymore to the initial diameter of the element being fused. The resulting gap should be sealed to preclude the effluence of molten flux and metal. Thus, from one heat to another the gap between side surfaces of the base plate and the element being fused becomes larger which eventually results in a rapid failure of the base plate. Such plants are inconvenient in servicing.

SUMMARY OF THE INVENTION

It is an object of the present invention to overcome the above disadvantages.

Another object of the present invention is to provide a guaranteed quality of fusion of elements to a casting body, more convenient servicing of the plant and extended service life of a base plate.

The method involves electroslag melting shaped castings by remelting a consumable electrode in a slag bath with concurrent fusion of elements, in which, at the initial stage the fusion process is carried out by introducing an element to be fused into the slag bath to 0.2–0.6 of the depth of the slag bath.

The melting process effected in the above manner ensures the uniform fusion of the end face of the element introduced into the slag bath and guaranteed fusion of this element to the casting body both along its outline and all over the cross section.

The fusion process preferably accomplished in the initial period by using a consumable electrode with a cross section that is at least equal to that of an element being fused.

In this case the droplets of remelted metal fall onto an already fused surface of the element being fused ensuring thereby the guaranteed quality of fusion.

A plant for casting shaped products comprising a consumable electrode coupled to a power source and introduced into a mold. The latter is mounted on a base plate which is split in the vertical plane. An element being fused is introduced into the slag bath through the base plate, from underneath. The plant is provided with means for moving the element being fused in the slag bath vertically and current-carrying jaws movable in the vertical plane and connected to the power source and means for pressing them against the element being fused. The molding part of the base plate consists of at least three sections, each of which is coupled to a resilient member that forces the section against the others and against the element being fused.

The vertical transfer gear is adapted for introducing the element being fused into the slag bath to a height ensuring its high-quality fusing to the casting body and facilitating the servicing of the plant.

The current-carrying jaws movable in a horizontal plane and furnished with the gear for urging them tight against the element being fused provide a reliable electrical contact and are simple and dependable in operation.

The use of the base plate molding part made up of at least three sections, of which each is coupled with the resilient clamping member, makes it possible to rule out the warping of the base plate due to thermal expansion of the element being fused, to enhance the plant reliability and to extend the service life of the base plate.

According to the present invention, each base plate section can be fitted with a heat-removing renewable insertion piece positioned in the place of contact with the element being fused, with the insertion piece height being at least equal to the radius of the element being fused.

The provision of each base plate section with a heat-removing renewable insertion piece disposed in the place of contact with the element being fused enables quick readjustment when passing over from melting a casting with a fused element of one type size to that of another size.

The height of the insertion pieces should be not less than the radius of the element being fused since this ensures its cooling and precludes thereby the burning through of the walls of the element at the initial moment of the melting process, and the runout of molten slag and metal.

According to the invention, the joints of the base plate sections are preferably stepped.

The above embodiment precludes the effluence of the molten slag and the metal along the base plate joint at the initial moment of the melting process owing to thermal expansion of the element being fused, when the base plate sections are displaced relative to one another.

The use of the herein-proposed method and plant for effecting the method allows diminishing materially the production costs in manufacturing shaped castings by using the electroslag melting technique and by fusing together individual elements. It also makes possible the avoidance of welding.

The method and plant described can be used for enlarging ingots by using billets cast in advance or manufactured by any existing method as elements to be fused. Moreover, when using the present invention a considerable saving is provided due to improved performance characteristics of metal and better quality of castings.

BRIEF DESCRIPTION OF THE DRAWINGS

The nature of the invention will be clear from the following detailed description of its particular embodiments to be had in conjunction with the accompanying drawings, in which.

DETAILED DESCRIPTION OF THE PREFERRED EMBODIMENT

Figure 1:
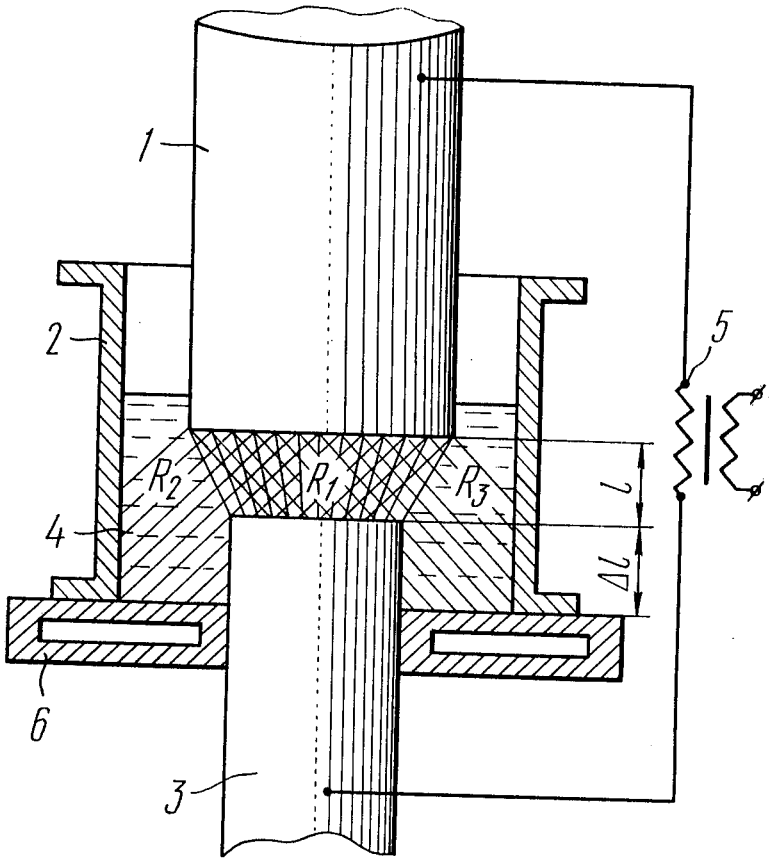
FIG. 1 is a schematic diagram illustrating the electroslag melting process.

The herein-proposed method of electroslag melting shaped castings consists essentially in that a consumable electrode 1 (FIG. 1) is introduced into the melting space of a mold 2 and an element 3 to be fused is mounted in the opening of a base plate 6 coaxially with the consumable electrode 1. Next molten slag is poured into the mold 2 to establish a slag bath 4 of a requisite height and electroslag melting is initiated by passing an electric current from a power source 5 through an electric circuit comprising the consumable electrode 1, the slag bath 4 and the element 3 to be fused. In the initial period the fusion process should be carried out by introducing the element 3 to be fused into the slag bath to 0.2–0.6 of the depth of the slag bath.

To illustrate the need in such a technological arrangement, the slag bath is considered as a sum of resistances R:

$$R_{total} = R_1 + R_2 + R_3,$$

where:

$R_1$ is the resistance of poles of the consumable electrode 1 and the element 3 to be fused;

$R_2$ and $R_3$ are the resistances of poles of the consumable electrode 1 and the base plate 6 (on both sides of the consumable electrode 1); and $R_{total}$ is the total resistance of the slag bath 4.

For the sake of simplicity the consumable electrode 1 and the element 3 to be fused are assumed to be arranged symmetrically within the melting space of the mold 2. Then $R_2$ may be considered to be equal to $R_3$.

With a constant input electric power fed to the slag bath 4 from the power source 5 a change in spacing $l$ between the electrode 1 and the element 3 will cause a redistribution of electric power in the slag bath 4, with the power value changing most intensively in the resistance $R_1$ since the resistances $R_2$ and $R_3$ are almost equal and vary negligibly with a change in the depth of introduction of the element 3 into the slag bath 4. A maximum specific electric power is released along the end face edges of the consumable electrode 1 and the element 3. As the spacing $l$ decreases, i.e., when the introduction increment $\Delta l$ of the element 3 becomes larger, the amount of the electric current passing through the element 3 increases, enhancing thereby the rate of fusing of the end face of the element 3 and, hence, providing better quality of fusion.

Moreover, an increase in the rate of fusion of the end face of the element 3 resulting from a larger introduction increment $\Delta l$ of the element 3 fed into the slag bath 4 is attributable to an increase in the contact surface area of the element 3 and the heated slag bath 4.

Thus, the deeper the element 3 is introduced into the slag bath 4, the better its fusion with the casting body.

However, with a small spacing $l$ the electroslag process is converted into an arc one, a feature which restricts the introduction increment $\Delta l$ of the element 3 to not more than 0.6 of the depth of the slag bath 4.

With the element 3 introduced into the slag bath 4 to a distance less than 0.2 of the bath depth, a metal bath established by melting the consumable electrode 1 comes in contact with the element 3 being fused along its still unfused surface, which does not ensure high-quality fusion of this element.

When the electroslag melting process is accomplished in its initial period with a consumable electrode 1 of a cross section that is equal to or exceeds that of the element 3, the drop metal transfer of the consumable electrode 1 occurs in such a way that the droplets of remelted metal fall on an already fused surface of the element 3 being fused, forming a common metal bath along the element outline. This ensures high quality fusion of the element 3 with the casting body.

The use of the consumable electrode 1 with a cross section smaller than that of the element 3 results in the droplets of electrometal falling on yet unfused surface on the end face of the element which does not provide high-quality fusion.

Considered hereinafter is a plant ensuring the electroslag melting of shaped castings with the concurrent fusing of individual parts during the melting process.

Figure 2:
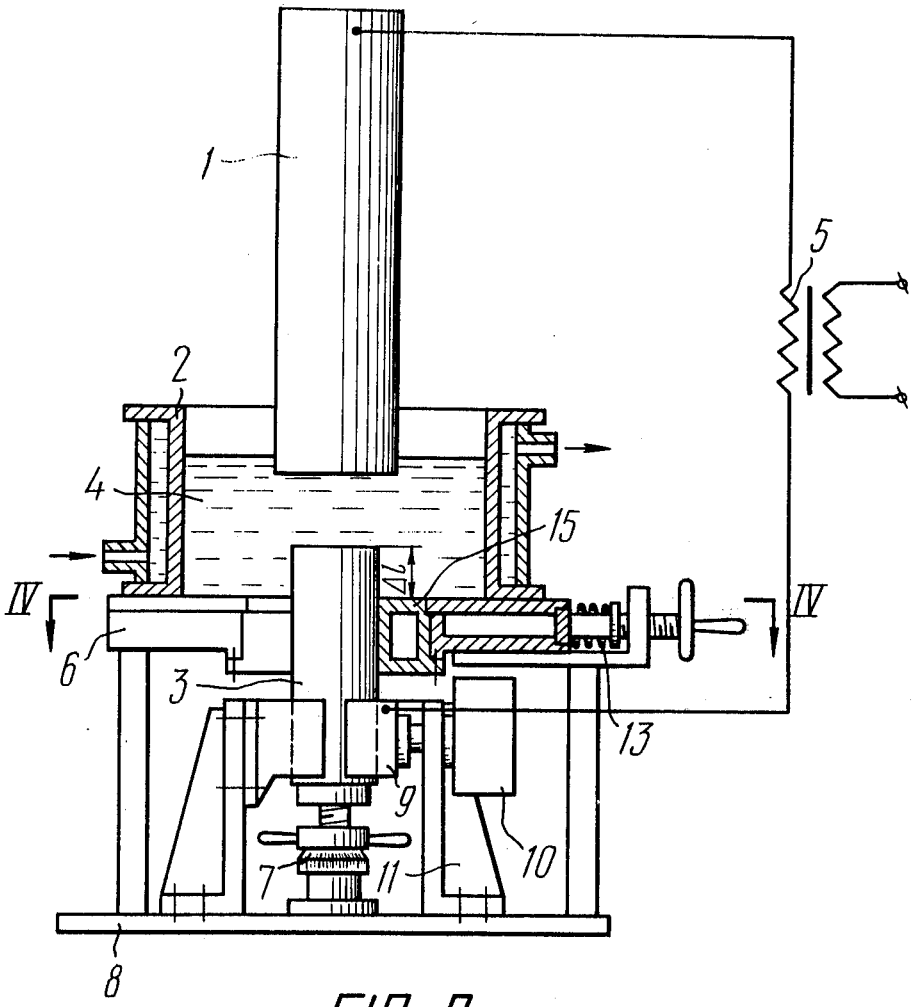
FIG. 2 is a schematic diagram of a plant for effecting the proposed method.
Figure 3:
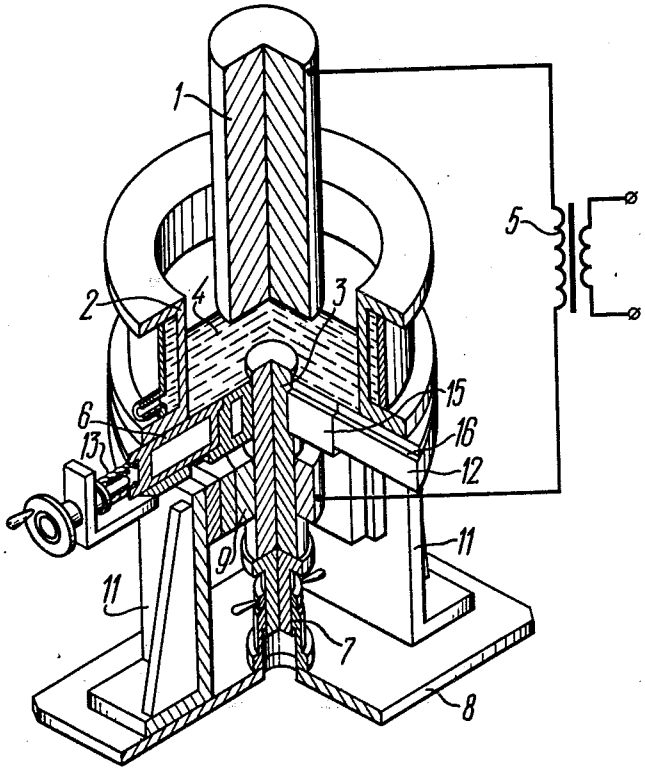
FIG. 3 is a general axonometric view of a plant for effecting the proposed method of electroslag melting shaped castings.

A plant for the electroslag melting of shaped castings comprises a consumable electrode 1 (FIGS. 2 and 3) introduced into the melting space of a cooled mold 2, and an element 3 to be fused that is extended into a slag bath 4 from below. The consumable electrode 1 and the element 3 are connected to a power source 5.

The mold is mounted on a base plate 6 with an opening aligned axially with the consumable electrode 1 and adapted to receive the element 3 being fused which is fed from below into the opening. The element 3 to be fused is set up on the top stage of a vertical transfer gear 7 fixed under the base plate 6 on a supporting plate 8, whereupon the element 3 is introduced with the help of the above gear 7 into the melting space of the mold 2. As for a drive of the gear 7, any known means, electromechanical, hydraulic, pneumatic, manual, etc., means can be employed.

An electric current is passed to the element 3 by means of current-carrying jaws 9 movable in a horizontal plane and coming in direct contact with their working surfaces with that of the element 3 being fused. The current-carrying jaws 9 are urged tight against the element 3 being fused (FIG. 2) with the help of a gear 10, with the jaws 9 being in that case positioned intermediate two vertical supports 11 with a possibility of relative displacement in a horizontal plane. Again, as in the first case, any known electromechanical, hydraulic, pneumatic, etc., means may be employed as a drive for the gear 10.

Figure 4:
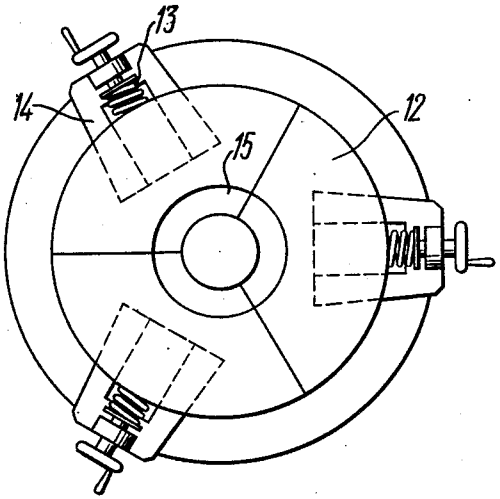
FIG. 4 is a sectional view taken along line IV—IV of FIG. 2.

The molding part of the base plate 6 is built up of three sections 12 (FIG. 4). Each section 12 is forced against each other and against the element 3 being fused with the help of a resilient clamping member 13 set up between the outer end face surface of the section 12 and a detainer 14 with a possibility of moving radially.

Each section 12 of the base plate 6 may be fitted with a heat-removing renewable insertion piece 15 which diminishes considerably the time for the preparation of the plant when passing over to melting shaped castings with another diameter of the element 3. The height of the renewable insertion piece 15 is at least equal to the radius of the element 3.

If the height of the insertion pieces 15 coming in contact with the element 3 is less than the radius of the element, then the walls of the element 3 will be burnt through at the initial moment of the melting process, and molten slag and metal will flow out. This is attributable to inadequate heat removal from the element 3 which is melted off, with its walls being burnt through below the place of contact of the renewable insertion pieces 15 with the element 3 being fused.

To preclude the effluence of molten slag and metal at the beginning of the melting process the joints 16 (FIG. 3) of the sections 12 of the base plate 6 and the renewable insertion pieces 15 are made stepped.

Such an embodiment is attributed to the fact that the heating of the element 3 causes its thermal expansion; as a result the detachable sections 12 and the renewable insertion pieces 15 of the base plate 6 move apart, forming gaps through which the slag and the metal can escape at the first moment of the melting process. The stepped joints 16 of the sections 12 and the renewable insertion pieces 15 of the base plate 6 preclude the effluence of both the slag and the metal.

The plant for effecting the herein-proposed method functions as follows.

The renewable insertion pieces 15 corresponding to the size of the element 3 are secured to the detachable sections 12 of the base plate 6. The element 3 to be fused is introduced by means of the vertical transfer gear 7 into the melting space of the mold 2 to 0.2–0.6 of the depth of the slag bath 4. Next, the current-carrying jaws 9 are set with the help of the clamping gear 10 in their working position so that they are brought in contact with the element 3 to be fused. A gap between the element 3 to be fused and the walls of the renewable insertion pieces 15 is eliminated by means of the resilient clamping member 13. After that the water-cooled mold 2 is mounted on the base plate 6, a slag bath 4 is established and the process of electroslag melting is initiated by melting the consumable electrode 1 in the slag bath 4 under the effect of an electric current. The heating of the element 3 causes its thermal expansion which is taken up by the resilient clamping member 13, a feature which precludes the warping of the base plate 6.

The influence of the depth of introducing the element 3 to be fused into the slag bath 4 and of the ratio between the cross sections of the consumable electrode 1 and the element 3 being fused on the quality of fusion was investigated on both a laboratory installation and an industrial one.

The elements to be fused were produced from rolled products. The quality of fusion was determined with the aid of macrosections and by non-destructive methods of inspection (gammagraphy and ultrasonic inspection).

An analysis of these results reveals that high-quality fusion is ensured when at the beginning of the process the element being fused is introduced into the slag bath to 0.2–0.6 of the depth of the slag bath with the consumable electrode 1 having a cross-section of not less than that of the element 3.

The industrial plant for the electroslag melting of shaped castings by using the above outlined technique was employed for producing an experimental-commercial lot (about 200 pieces) of cover blanks for fitting bodies of atomic power plants. All of them were checked for quality of the fusion zone and of the base casting metal by the non-destructive methods.

The quality of fusion in all castings was good and defects in the form of porosity, cracks, cold laps, etc., were absent.

An analysis of the above results shows that the state of mechanical properties and impact toughness of the metal in a transition zone and of the cast metal obtained by electroslag melting are isotropic. They are similar to corresponding characteristics of rolled products obtained for specimens cut out along rolled fibers.

Experimental heats treated on the industrial electroslag melting plant have fully demonstrated its reliability, ease of servicing and absence of marked warping of the base plate and other design elements of the plant.

What we claim is:

1. In a plant for the electroslag melting of shaped castings by electroslag remelting of consumable electrodes in a cooled mold mounted on a base plate having an aperture through which a member to be fused in the course of melting is inserted, the improvement being in that the base plate is of a composite construction split along vertical planes, and that the molding part of the base plate comprises at least three sections, resilient members connected to each of said sections for forcing the sections against each other and against the member being fused; said mold adapted to accommodate a consumable electrode connected to a power source; means for the vertical movement of the member being fused said means adapted to insert the member into the slag bath through the aperture in said base plate; and current-carrying jaws movable in the horizontal plane, said jaws being connected to means adapted to urge them against the member being fused and having electric contact with said power source.

2. The plant of claim 1, wherein each of the base plate sections is provided with a heat-removing renewable insertion piece adapted to contact the element to be fused, the height of the insertion piece being at least equal to the radius of the element to be fused.

3. The plant of claim 2, wherein the contact surfaces between the base plate sections and the renewable insertion pieces are stepped.

* * * * *